United States Patent [19]

Crawford

[11] 4,339,051

[45] Jul. 13, 1982

[54] SILVERWARE BASKET

[75] Inventor: John G. Crawford, Louisville, Ky.

[73] Assignee: General Electric Company, Louisville, Ky.

[21] Appl. No.: 179,344

[22] Filed: Aug. 18, 1980

[51] Int. Cl.[3] ..... B65D 7/20; B65D 7/42; A47G 19/08; B08B 13/00

[52] U.S. Cl. ..... 220/66; 220/19; 220/83

[58] Field of Search ..... 220/19, 66, 83; 211/71, 211/41

[56] References Cited

U.S. PATENT DOCUMENTS

| | | | |
|---|---|---|---|
| 3,027,041 | 3/1962 | Stansbury . | |
| 3,182,854 | 5/1965 | Geller . | |
| 3,294,273 | 12/1966 | Ettlinger . | |
| 3,341,064 | 9/1967 | Ricci | 220/66 |
| 3,517,606 | 6/1970 | Myles et al. . | |
| 3,638,824 | 1/1972 | Sekiguchi | 220/66 |
| 3,665,943 | 5/1972 | Lampman et al. . | |
| 3,941,273 | 3/1976 | Dalencon . | |
| 4,157,145 | 6/1979 | Jordan . | |
| 4,192,432 | 3/1980 | Jordan . | |

*Primary Examiner*—George E. Lowrance
*Attorney, Agent, or Firm*—Radford M. Reams

[57] ABSTRACT

A silverware basket for use in a dishwasher for holding silverware during washing, rinsing and drying operations. The basket has side walls extending upwardly from a generally perforate bottom wall. The bottom wall comprises an open grid formed by a plurality of intersecting undulating ribs. Each rib comprises rib portions extending between points of intersection which are slanted relative to the horizontal and also relative to adjacent rib portions such that each point of intersection is vertically displaced relative to each adjacent point of intersection, so as to provide an uneven bottom surface which reduces silverware nesting, improves drainage from the basket, and provides a relatively large open area for admitting wash water through the bottom wall into the basket. Short upwardly extending pins are distributed along each rib, each being positioned approximately midway between adjacent points of intersection, to further impede sliding and induce separation of silverware items in the basket.

9 Claims, 5 Drawing Figures

PRIOR ART

SILVERWARE BASKET

BACKGROUND OF THE INVENTION

This invention relates to silverware baskets for dishwashers.

Silverware in a dishwasher is generally more difficult to dry than other items. This difficulty is believed due at least in part to the phenomenon known as "nesting" which results when silverware items are in close contact with one another such as two spoons stacked together. Because of their close proximity, water tends to be retained between the "nested" items rendering it difficult to evaporate. An additional problem created by "nesting" is that food soils may be trapped between nested items degrading wash performance.

Silverware baskets employed in commercially available dishwashers come in a variety of sizes and shapes. Typically, these baskets include a gridded bottom wall having a relatively large open area to permit washing action in the basket by washing liquid entering from beneath the basket as well as from above. Most grid bottoms are of generally planar construction as shown in FIG. 1A which can contribute to nesting by permitting silverware items to slide across the planar surface. The washing action may itself jostle silverware items along the surface into nesting contact with other items.

One approach known in the art for reducing nesting involves providing relatively large upwardly extending fingers 1 spaced about the bottom which may be cylindrical as shown in FIG. 1B or tapered as described in commonly-assigned U.S. Pat. No. 3,182,854 to Geller. Another approach as illustrated in FIG. 1C, involves a grid having a plurality of square segments 2 formed by intersecting co-planar ribs 3 and including within each square segment a pair of intersecting ribs 4 having a point of intersection 5 lower in elevation than the plane of the square segments 2 taking the shape of an inverted pyramid.

It is a primary object of the present invention to provide a silverware basket which provides a significant improvement in silverware drying performance.

It is a further object of the present invention to provide a silverware basket which enhances draining of the water away from the silverware, which increases the open area and which reduces nesting.

It is a further object of the present invention to improve silverware wash and dry performance in dishwashers by providing a silverware basket having a bottom surface which reduces sliding and induces separation of silverware randomly loaded in the basket.

SUMMARY OF THE INVENTION

The foregoing objects are achieved by the present invention which provides an improved silverware basket for dishwashers having a perforate bottom wall and sidewalls wherein the bottom wall comprises a grid formed by a plurality of intersecting undulating ribs. Each rib portion extending between points of intersection is slanted relative to the horizontal and relative to each adjacent rib portion in such a manner that each point of intersection is vertically displaced relative to each adjacent point of intersection, so as to provide an uneven bottom surface which significantly reduces nesting of silverware received in the basket, enhance drainage from the basket and present a relatively large open area for admitting wash water to the basket upwardly through the bottom wall. Nesting is further reduced by short upwardly extending pins disposed along each rib approximately midway between points of intersection which further impedes sliding of the silverware items in the basket and induces a degree of separation of the silverware items.

In one form of the invention the grid is formed by two sets of undulating ribs. The two sets of ribs are disposed transverse to each other and each rib has alternating peaks and valleys formed along its length. Each rib is displaced horizontally and vertically relative to each adjacent parallel rib such that each set comprises alternating high and low ribs. The two sets of ribs are arranged to intersect such that each one of the peaks and valleys of each one of the high ribs of one set intersect the peaks of the ribs in the other set and each one of the peaks and valleys of each one of the low ribs of the one set of ribs intersects the valleys of the ribs of the other set of ribs. By this arrangement each point of intersection is vertically displaced relative to each of its adjacent points of intersection.

DETAILED DESCRIPTION OF THE INVENTION

The subject matter of this invention is particularly pointed out and distinctly claimed in the concluding portion of this specification. The invention, however, may be best understood by reference to the following description taken in conjunction with the accompanying drawings.

Figure 1A:
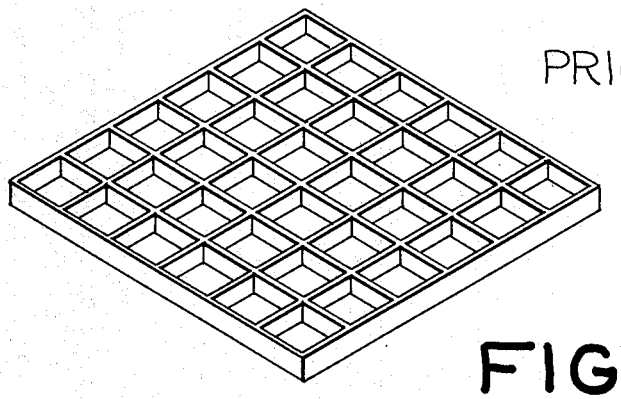
FIG. 1A PRIOR ART
FIGS. 1A, 1B and 1C are perspective views of portions of grid structures which have been employed in bottom walls of dishwasher silverware baskets.
Figure 1B:
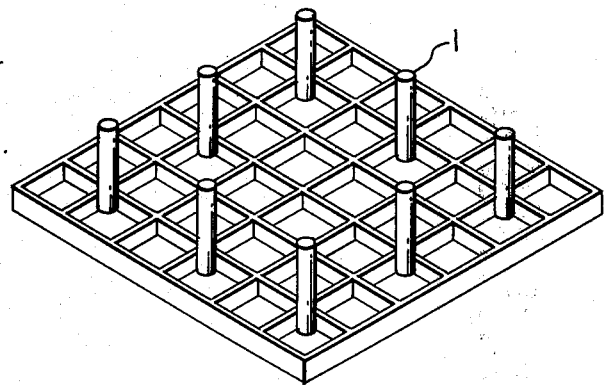
FIG. 1B PRIOR ART
Figure 1C:
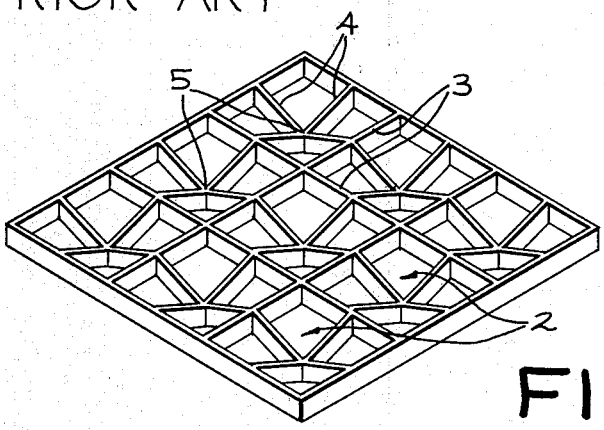

FIGS. 1A, 1B and 1C, as mentioned briefly in the foregoing Background section, illustrate various ways in which silverware basket bottom walls are presently configured. FIG. 1A shows the commonly employed planar grid formed by transversly disposed straight ribs. FIG. 1B shows a modification to that of FIG. 1A in which relatively large vertical projections extend upwardly from a plurality of intersections of the ribs. The projections may be cylindrical as shown in FIG. 1B or tapered as shown in the aforementioned U.S. Pat. No. 3,182,854 to Geller. The grid arrangement of FIG. 1C shows a grid arrangement wherein certain points of intersection are lowered relative to the generally planar frame grid giving the basket wall a contour which resembles a plurality of adjacent inverted pyramids.

Figure 2:
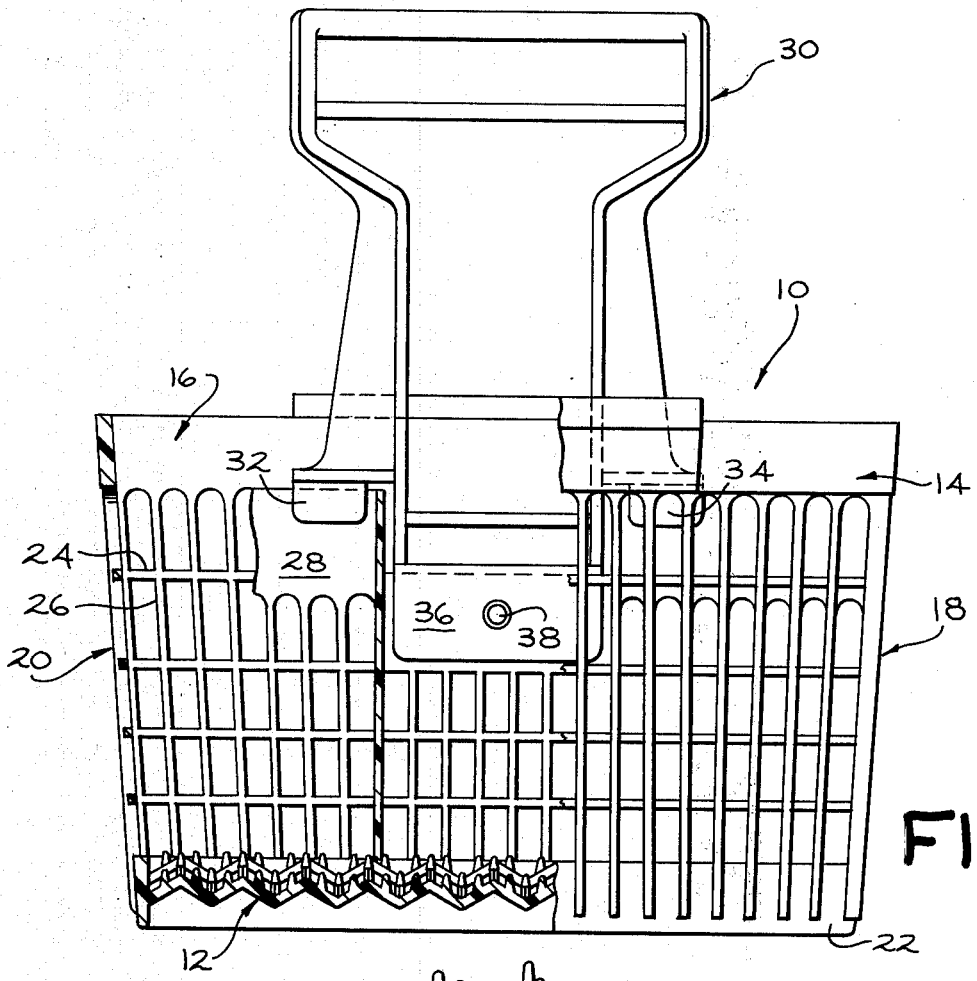
FIG. 2 is a side elevational view of a silverware basket embodying the present invention with portions cut away to show details of interior portions of the basket.

Referring now to FIG. 2, a silverware basket designated generally 10, illustratively embodying the present invention, is shown. Basket 10 includes a bottom wall 12 and sidewalls 14, 16, 18 and 20 which project upwardly from the bottom wall to define a space for receiving items to be washed in the basket. A rectangular frame base 22 surrounds bottom wall 12 and extends slightly below bottom wall 12 to provide a smooth support surface and to provide clearance between bottom wall 12 and the bottom of the dishrack (not shown) when the basket 10 is placed in a dishwasher. Sidewalls 14–20 are of open lattice work construction comprising generally coplanar horizontal and vertical ribs 24 and 26, respectively. A partition 28 of similar construction to the sidewalls 14–20 is centrally disposed in the basket between and parallel to sidewalls 14 and 16. A handle designated generally 30 extends upwardly from partition 28. Handle 30 is positioned on basket 10 by two pairs of opposed guide tabs 32 and 34 and a pair of opposed flanges 36. Handle 30 is supported on partition 28 which is sandwiched between the opposed guide tabs 32 and 34 and flanges 36. Handle 30 is retained in position by pin 38 which passes through flanges 36 and partition 28.

The particular details of the sidewalls and handle structure of the basket are not part of the present invention and it is understood that various different sidewall and handle configurations could be provided with the bottom wall configuration of the present invention.

Figure 3:
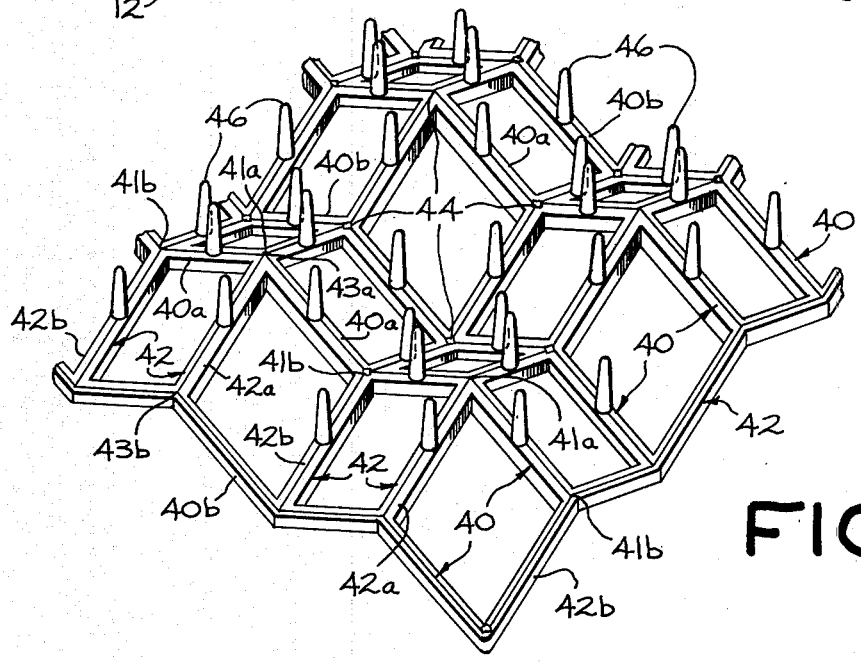
FIG. 3 is a perspective view of a portion removed from the bottom wall of the silverware basket of FIG. 2.

As best seen in FIG. 3, the bottom wall 12 of basket 10 is an open grid formed of a first plurality of parallel undulating ribs designated generally 40 and a second plurality of parallel undulating ribs designated generally 42 which extend transversely to ribs 40. Each one of ribs 40 is spaced apart vertically and horizontally from its adjacent parallel ribs. Similarly, each one of ribs 42 is spaced apart vertically and horizontally from its adjacent parallel ribs. It is essential to the present invention that each rib portion connecting adjacent points of intersection between ribs 40 and 42 be slanted relative to the basket horizontal and that each point of intersection 44 between ribs 40 and ribs 42 be displaced vertically from all adjacent points of intersection. Points of intersection adjacent to a particular point of intersection are those points of intersection next occurring along ribs intersecting at that particular point. The slanted ribs and vertical displacement facilitate drainage of wash liquid from the basket by providing sloping drainage surfaces and minimizing potential contact surface area between the ribs and silverware items received in the basket which could retain washing liquid; facilitates entry of washing liquid into the basket through wall 12 by skewing the planes of the grid openings to increase the open area through which washing liquid may enter; and reduces nesting of articles received in the basket by providing an uneven surface which hinders sliding of items in the basket.

In the illustrative embodiment the ribs 40 are parallel to each other and ribs 42 are parallel to each other and the intersecting ribs are transverse to each other. However, it is understood that satisfactory results may be obtained with other configurations which may include non-parallel ribs and ribs which intersect other than transversely, provided that the rib portions connecting adjacent points of intersection are slanted relative to the horizontal and that each point of intersection is vertically displaced relative to each of its adjacent points of intersection.

In the illustrative embodiment, the vertical displacement at the points of intersection is achieved by forming each of ribs 40 and 42 with alternating peaks and valleys designated **41*a* and 41*b*, respectively, for ribs 40, and 43*a* and 43*b*, respectively, for ribs 42, evenly spaced along the length of the ribs; and by arranging the ribs such that each one of ribs 40 and 42 is displaced horizontally and vertically from its adjacent parallel ribs with alternate ribs being horizontally aligned. This arrangement results in alternate high and low ribs designated 40*a* and 40*b*, respectively for ribs 40, and 42*a* and 42*b*, respectively for ribs 42. Each peak and valley of each one of ribs 40 intersects a peak or valley of ribs 42. More specifically, each one of the peaks 41*a* and valleys 41*b* of high ribs 40*a* intersects one of the peaks 43*a* of ribs 42 and each peak 41*a* and valley 41*b* of low ribs 40*b* intersects a valley 43*b* of low ribs 42*b*, so that each point of intersection of ribs 40 and 42** is displaced vertically relative to all adjacent points of intersection.

In addition to reducing nesting by providing an undulating bottom wall, the bottom wall 12 of basket 10 enhances the washing action in the basket by providing increased open area in the grid as a result of the skew of the planes of the grid opening between ribs 40 and 42 which permits greater freedom of entry to washing liquid entering the basket from below, and also further contributes to improved drying performance by enhancing drainage of washing liquid from the basket by sloping all of the ribs, thereby eliminating any substantial flat surfaces upon which washing liquid would collect and also greatly reducing the potential contact area between silverware items received in the basket and the ribs, which could retain washing liquid.

To further enhance the ability of the basket bottom of the present invention to reduce nesting, a plurality of generally vertical short projections or pins 46 are formed along ribs 40 and 42 projecting upwardly from the ribs. In the illustrative embodiment, pins 46 are formed along ribs 40 and 42 with one of pins 46 being positioned generally midway between each point of intersection 44 of ribs 40 and 42. These pins, particularly when placed midway between points of intersection as in the illustrated embodiment, not only prevent sliding of items received in the basket but also tend to induce a separation of the items.

The spacing of pins 46 and the dimensions of the grid are sufficiently small relative to the dimensions of typical silverware items, that separation of the silverware items is induced by engagement of the items with the basket bottom when the items are randomly placed in the basket. In order to effectively induce separation, the pins must be long enough to retain one item wedged between a particular pin or set of adjacent pins and the nearby ribs, other pins or other items, but not long enough to retain two items similarly wedged against the same pin or set of pins. When so configured and distributed, the undulating ribs and the pins not only prevent nesting of silverware items when jostled during washing and rinsing operations by hindering sliding of the items along the bottom wall but also tend to induce separation of silverware items as they are placed in the basket. This is a particularly significant feature since items may be initially nested prior to placement in the basket.

Satisfactory wash and dry performance was demonstrated with basket 10 which in the illustrative embodiment except for handle 30 is of one-piece plastic construction formed by a molding operation. The rib undulations have a nominal slope of 30° measured from the horizontal and a nominal horizontal separation between peaks and valleys along each ribs of 0.34 inches. The length of the pins measured from the intersection of the pin and the rib to the top of the pin is approximately $\frac{1}{8}$ inch.

An additional advantageous feature of the present invention is that it permits efficient use of the storage or load space in the basket. The combination of slanting rib portions and pins positioned along the slanted portions midway between the peaks and valleys provides vertical separation as well as horizontal separation of items received in the basket. Thus, items may be relatively closely spaced horizontally and yet not be prone to nest because of the relatively vertical displacement of such closely spaced items.

It is apparent from the foregoing that the present invention provides an improved silverware basket for use in dishwashers which enables improved silverware washing and drying performance by incorporating a basket structure which significantly reduces nesting while at the same time enhancing entry of liquid into the basket from below during wash operations and drainage from the basket during drying operations.

While a specific illustrative embodiment of the invention has been described and illustrated herein, the invention is not limited to the precise construction disclosed. It is realized that numerous modifications and changes will occur to those skilled in the art which do not depart from the invention. It is therefore to be understood that the appended claims are intended to cover all such modifications and changes as fall within the true spirit and scope of the invention.

What is claimed is:

1. A silverware basket for use in a dishwasher comprising: a perforate bottom wall and sidewalls extending upwardly from said bottom wall defining a space for receiving items to be washed; said bottom wall being formed of a first plurality of parallel undulating ribs, each rib being spaced apart horizontally and vertically from its adjacent ribs, and a second plurality of parallel undulating ribs extending at an angle to said first plurality of ribs, each one of said second plurality of ribs being spaced apart vertically and horizontally from its adjacent ribs, each one of said first plurality of ribs intersecting each one of said second plurality of ribs such that each point of intersection is displaced vertically from its adjacent points of intersection.

2. A silverware basket for use in a dishwasher comprising: a perforate bottom wall and sidewalls extending upward from said bottom wall, and defining therein a space for receiving items to be washed; said bottom wall comprising a first plurality of parallel ribs, each rib having alternating peaks and valleys evenly spaced along its length and each rib being spaced apart horizontally and vertically from its immediately adjacent ribs; and a second plurality of parallel ribs formed at an angle to said first plurality of ribs, each rib being spaced apart horizontally and vertically from its immediately adjacent ribs; each peak and valley of said first plurality of ribs intersecting a peak or valley of said second plurality of ribs such that each point of intersection is displaced vertically from each of its adjacent points of intersection.

3. A silverware basket for use in a dishwasher comprising: a perforate bottom wall and sidewalls extending upwardly from said bottom wall defining therein a space for receiving items to be washed; said bottom wall comprising a first plurality of undulating parallel ribs, each rib having alternate peaks and valleys evenly spaced along its length and each rib being displaced horizontally and vertically from its immediately adjacent ribs to form alternate high and low ribs; and a second plurality of undulating parallel ribs extending transverse to said first plurality of ribs, each one of said second plurality of ribs having alternating peaks and valleys spaced evenly along its length and each rib being spaced apart horizontally and vertically from its adjacent ribs to form alternating high and low ribs, said first plurality of ribs intersecting said second plurality of ribs such that each one of said peaks and valleys of said high ribs in said first plurality of ribs intersects one of said peaks of said second plurality of ribs and each one of said peaks and valleys of said low ribs in said first plurality or ribs intersects one of said valleys of said second plurality of ribs, whereby each point of intersection between said first plurality of ribs and said second plurality of ribs is displaced vertically from each of its adjacent points of intersection.

4. A silverware basket in accordance with claim 1 or 2 or 3 further comprising a plurality of short generally vertical projections extending upwardly from said first and second plurality of ribs.

5. A silverware basket in accordance with claim 4 wherein each one of said plurality of vertical projections is positioned along one of said first and second pluralities of ribs generally midway between said points of intersection.

6. A silverware basket for use in a dishwasher comprising: a perforate bottom wall and sidewalls extending upwardly therefrom to define a space for receiving items to be washed; said bottom wall comprising a first plurality of undulating parallel ribs, each rib having alternating peaks and valleys along its length and each rib being spaced apart horizontally and vertically from its adjacent ribs to form alternate high and low ribs; and a second plurality of parallel ribs, each one of said second plurality of ribs having alternating peaks and valleys formed along its length and each one of said second plurality of ribs being displaced horizontally and vertically from its immediately adjacent ribs to form alternate high and low ribs; said first plurality of ribs intersecting said second plurality of ribs such that each of said peaks and valleys of said high ones of said first plurality of ribs intersects one of said peaks of said second plurality of ribs and each of said peaks and valleys of said low ones of said first plurality of ribs intersects one of said valleys of said second plurality of ribs thereby vertically displacing each point of intersection between said first and second plurality of ribs relative to its adjacent points of intersection; and a plurality of short upwardly extending pins, each one of said pins projecting from one of said first and second pluralities of ribs generally midway between points of intersection.

7. A silverware basket for use in a dishwasher comprising: a bottom wall and sidewalls extending upwardly from said bottom wall defining a space for receiving items to be washed; said bottom wall comprising an open grid formed of a plurality of intersecting undulating ribs, each one of said plurality of undulating ribs intersecting at least one other one of said undulating ribs, each rib comprising rib portions extending between points of intersection, each of said rib portions being slanted relative to the horizontal and relative to each of its adjacent rib portions; and each point of intersection being displaced vertically from each of its adjacent points of intersection.

8. A silverware basket in accordance with claim 7 further comprising a plurality of short generally vertical projections extending upwardly from said plurality of ribs.

9. A silverware basket in accordance with claim 8 wherein each one of said plurality of vertical projections is positioned along one of said plurality of ribs generally midway between said points of intersection.

* * * * *